US005673908A

United States Patent [19]

Nagata et al.

[11] Patent Number: 5,673,908

[45] Date of Patent: Oct. 7, 1997

[54] PAPER FEEDING APPARATUS

[75] Inventors: Jinichi Nagata, Osaka; Toshirou Kurishita, Nara; Mitsuo Matsuda, Hiroshima, all of Japan

[73] Assignee: Sharp Kabushiki Kaisha, Osaka, Japan

[21] Appl. No.: 561,022

[22] Filed: Nov. 21, 1995

[30] Foreign Application Priority Data

Nov. 21, 1994 [JP] Japan ..... 6-286812

[51] Int. Cl.[6] ..... B65H 5/08

[52] U.S. Cl. ..... 271/11; 271/90; 271/107

[58] Field of Search ..... 271/90, 94, 95, 271/96, 105, 107, 11

[56] References Cited

U.S. PATENT DOCUMENTS 4,168,829 9/1979 Wilson et al. .
5,028,043 7/1991 Karolyi ..... 271/95

FOREIGN PATENT DOCUMENTS 0061243 5/1981 Japan ..... 271/94
0020291 2/1985 Japan ..... 271/95
2147441 12/1990 Japan .
1715695 2/1992 U.S.S.R. ..... 271/94

OTHER PUBLICATIONS

Muka, Document feeder with improved vacuum system, Nov. 1981, Research Disclosure No. 21139.

*Primary Examiner*—H. Grant Skaggs

[57] ABSTRACT

A paper feeding apparatus of uncomplicated structure which can be easily controlled and does not require the necessity of a large motor is implemented at low cost without undergoing the lowering of an attracting force, air leakage and paper contamination. To the outer circumferential surface of a drum-shaped cylinder with air holes are attached, ring-shaped collar having respective air holes and following conveyance elements. The cylinder is inserted through the ring-shaped collars and the following conveyance elements. Each following conveyance element includes a bearing covered with a cover to prevent paper contamination. The bearing is secured to the cylinder by the securing action of the collars.

16 Claims, 12 Drawing Sheets

FIG. 4A OFF-STATE OF SOLENOID
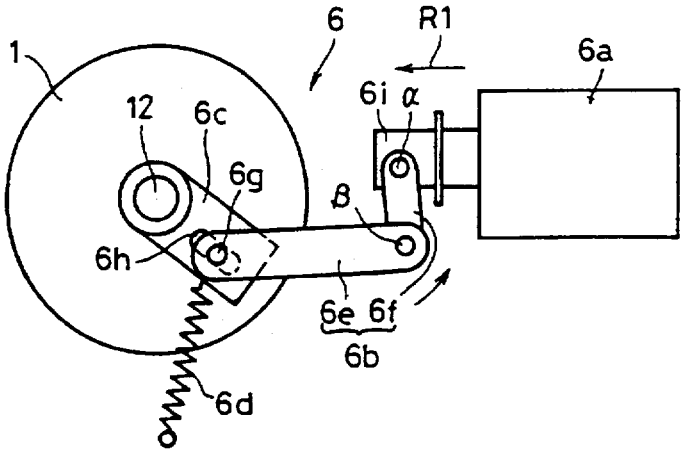
FIG. 4B NEUTRAL-STATE OF SOLENOID
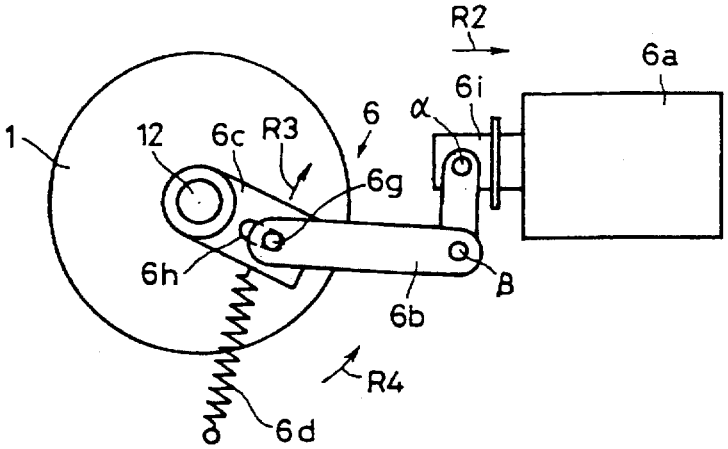
FIG. 4C ON-STATE OF SOLENOID
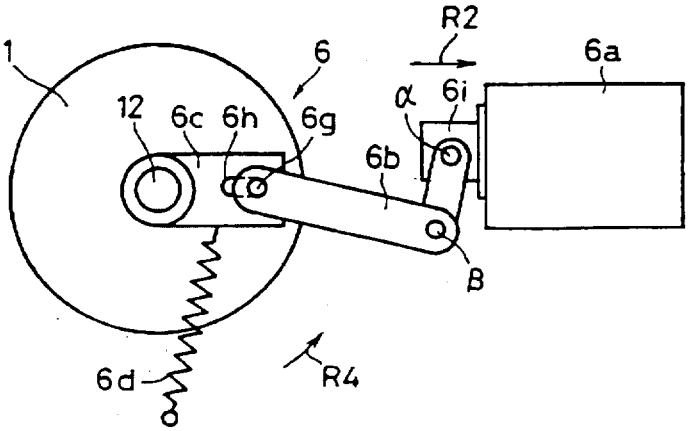

PAPER FEEDING APPARATUS

BACKGROUND OF THE INVENTION

1. Field of the Invention

This invention relates to a paper feeding apparatus using a suction system for picking up one sheet of paper from a stack of paper by suction and feeding the sheet.

2. Description of the Related Art

A paper feeding apparatus for picking up the uppermost or lowermost one from stacked sheets of paper and feeding the sheet has been used in a variety of apparatuses including a copying machine and a printer. To pick up one sheet of paper from a stack of paper, such a paper feeding apparatus has generally adopted a method using either a roller or a suction mechanism. The present invention relates to the method using a suction mechanism. Taking suction systems disclosed in Japanese Unexamined Utility Model Publication JPU 2-147441(1990) and in U.S. Pat. No. 4,168,829 as examples, the structure of conventional paper feeding apparatuses will be described.

As shown in FIGS. 13A and 13B, the apparatus disclosed in Japanese Unexamined Utility Model Publication JPU 2-147441(1990) is for picking up seriatim sheet materials (photosensitive materials) 102 contained in a container 101 from the bottom of the container 101 one by one. An outlet for the sheer materials 102 is located to face a drum 103. In the outer circumferential surface of the drum 103 is formed an edge attracting face 104 which presents a notch-shaped face and a trail attracting face 105 located upstream of the edge attracting face 104 in the direction of the rotation of the drum 103. The edge attracting face 104 and the trail attracting face 105 are formed with suction holes 104*a* and suction holes 105*a*, respectively. The interior of the drum 103 is divided by a partition wall 108 into two parts, which are an edge attracting zone 106 and a trail attracting zone 107. In the edge attracting zone 106 are formed the attracting holes 104*a*. In the trail attracting zone 107 are formed the attracting holes 105*a*. Individual negative-pressure sucking means are connected to the edge attracting zone 106 and the trail attracting zone 107. In the vicinity of the drum 103 and at the downstream side in the direction of the rotation thereof is disposed a feed roller 109 for conveying the sheet materials received from the drum 103.

A method of feeding the sheet materials by means of the structure will be described. As shown in FIG. 13A, when the edge attracting face 104 is let face outlet of the container 104 and the edge attracting zone 106 is placed into a negative pressure, an edge portion of the sheet material 102 in the container 101 is attracted by the edge attracting face 104. In this state, when the trail attracting zone 107 is placed into a negative pressure while rotating the drum 103 in the direction indicated by the arrow in the drawing, a trailing portion of the sheet material 102 is attracted by the trail attracting face 105, so that the sheet material 102 is fed. Then, as shown in FIG. 13A, when the negative pressure in the edge attracting zone 106 is released as soon as the edge attracting face 104 reaches the vicinity of the feed roller 109, the edge portion of the sheet material 102 moves away from the drum 103 toward the feed roller 109. Meanwhile, the trailing portion of the sheet material 102 is attracted and held by the trail attracting face 105. The negative pressure in the trail attracting zone 106 is released after the edge portion has been engaged with the feed roller 109.

As shown in FIG. 14, the apparatus disclosed in U.S. Pat. No. 4,168,829 is for picking up paper 112 contained in a paper cassette 111 from the bottom thereof and feeding the paper, but the paper 112 is picked up and fed only one by one. The apparatus comprises a feeder 113 for picking up paper in the vicinity of an outlet formed on a bottom surface of the paper cassette 111. The feeder 113 is shaped like a drum, which is formed with a suction hole 114 in a circumferential surface thereof and internally supplied with a negative pressure. The suction hole 114 attracts an edge portion of the paper 112 in the vicinity of the outlet of the paper cassette 111. On the downstream side in the direction of the rotation of the feeder 113 is disposed a roller 116. As shown in the side view, the outer circumferential surface of the feeder 113 is partially formed with concave portions 113*a*, into which bearings 115 have been fitted. The bearings 115 are flush with the outer circumferential surface of the feeder 113. The roller 116 contacted the bearings 115.

A method of picking up the paper 112 in the paper cassette 111 by means of the structure will be given. Initially, the inside of the feeder 113 is put into a negative pressure in the state where the suction hole 114 of the feeder 113 is opposed to the vicinity of the outlet of the paper cassette 111, so that the edge of the paper 112 is attracted by the suction hole 114 portion in the circumferential surface of the feeder 113. At this point, when the feeder 113 is rotated in the direction indicated by the arrow in the drawing, the paper 112 is dispensed until the edge thereof reaches the position corresponding to the roller 116, where the paper 112 is held between the feeder 113 (bearings 115) and the roller 116. Even when the negative pressure attracting the edge of the paper is released thereafter, the paper 112 remains held between the feeder 113 and the roller 116, so that the paper 112 can be handed over to a conveyer roller (not shown).

However, in the apparatus disclosed in Japanese Unexamined Utility Model Publication JPU 2-147441(1990), the two sucking zones 106 and 107 should be provided in order to individually control the negative pressures in the respective sucking zones 106 and 107, resulting in intricate structure and complicated control. Moreover, since the paper is held only by air suction, the paper is easily warped. Furthermore, individually controlling the two sucking zones requires an increased amount of air with an increased loss in air, which increases the size of a suction motor which in a disadvantage.

In the apparatus disclosed in U.S. Pat. No. 4,168,829, on the other hand, the paper 112 having been picked up is conveyed while being held between the bearings 115 fitted into the feeder 113 and the roller 116, so that the concave portions 113*a* should be formed in the circumferential surface of the feeder 13 in order to make the bearings 115 flush with the outer circumferential surface of the feeder, thereby preventing the paper 112 from waving during conveyance of the paper 112. However, this complicates the form of the feeder 113, resulting in high cost. In addition, the manufacturing process of fitting the bearings 115 into the feeder 113 is also complicated. On the other hand, since the bearings 115 are brought into direct contact with the paper, the paper is contaminated by anticorrosive oil or the like coated on the bearings 115. Moreover, since the bearings 115 typically used are standardized items, their dimensions including widths are unchangeable. Accordingly, in the case of conveying paper while holding the paper between the bearings 115 and the roller 116, a paper conveying surface is restricted to a small area, so that a sufficiently large paper conveying force cannot be easily obtained. Furthermore, since the attracting portion 114 for attracting the edge of the paper is provided in the circumferential surface of the drum-shaped feeder 113 so as to attract the edge of the paper onto the arc circumferential surface, air leakage resulting from the resilience of the paper 112 easily occurs anterior or posterior to the sucking portion 114 in the direction of paper conveyance, which leads to such problems as the lowering of the attracting force, noise due to the air leakage, and the upsizing of an air suction motor which is inevitable in order to provide a sufficiently large amount of air.

SUMMARY OF THE INVENTION

It is hence an object of the invention to provide a low-cost paper feeding apparatus of a simple structure which can be controlled easily and which does not require the provision of a large fan or a large motor. It is another object of the invention to provide a paper feeding apparatus which is free from such problems as the lowering of an attracting force, air leakage, and paper contamination.

The invention provides a paper feeding apparatus comprising:

- a drum-shaped cylinder disposed in the vicinity of a paper outlet of a hopper containing sheets of paper, in a circumferential face of which is formed an air hole;
- sucking means for sucking air from the cylinder;
- a driving conveyance element (driving element for conveyance) disposed in the vicinity of an outer circumferential surface of the cylinder;
- a following conveyance element provided on the outer circumferential surface of the cylinder, the following conveyance element being rotatable independent of rotation of the cylinder and being contacted with the driving conveyance element;
- a paper attracting element secured to the outer circumferential surface of the cylinder and having an air hole communicating with an air hole of the cylinder, the paper attracting element whose top surface is substantially flush with the top surface of the following conveyance element; and
- cylinder rotating means for rotating the air hole of the cylinder between the vicinity of the paper outlet and the driving conveyance element.

The paper feeding apparatus of the invention is characterized in that a distance L1 between the top face edge of the air hole at the upstream side in a direction of paper conveyance and the axial line of the cylinder rotation and a distance L2 between the top face edge of the air hole at the downstream side in the direction of paper conveyance and the axial line of the cylinder rotation are set to have a relationship represented by L1>L2.

The paper feeding apparatus of the invention is characterized in that a face including the top face edge of the air hole at the upstream side in a direction of paper conveyance and the top face edge of the air hole at the downstream side in the direction of paper conveyance is formed into a plain face.

Further the paper feeding apparatus of the invention is characterized in that the paper attracting element is composed of a plurality of collars and the following conveyance element is composed of a bearing, the bearing being positioned on the outer circumferential surface of the cylinder and secured thereto by holding the bearing between the collars.

Still further the paper feeding apparatus of the invention is characterized in that the bearing of the following conveyance element has a ring-shaped cover made of an elastic material such as resin or rubber on a circumferential surface thereof.

A paper feeding operation by the paper feeding apparatus of the invention will be described. In the process of feeding paper, the air hole of the cylinder, i.e., the air hole portion of the paper attracting element is initially opposed to the vicinity of the paper outlet of the hopper with the cylinder rotating means. At this point, when the air in the cylinder is sucked by the sucking means, the paper exposed from the paper outlet to the outside is attracted to a surface of the paper attracting element through the respective air holes of the cylinder and the paper attracting element. Subsequently, the cylinder rotating means rotates the cylinder and moves the paper attracted to the air hole to rollers serving as driving conveyance elements. To the driving conveyance rollers has been previously transmitted a driving force, so that the driving conveyance rollers and the following conveyance element are rotating in the direction of paper conveyance. The paper conveyed to the point by the rotation of the cylinder is held between the driving conveyance rollers and the following conveyance element and further conveyed in the direction of paper conveyance by the combined conveying force of both of the elements, whether the cylinder is rotating or not rotating. Since the top surface of the paper attracting element has been set substantially flush with the top surface of the following conveyance element, a paper conveying surface constituted by the cylinder becomes substantially flush with a paper conveying surface constituted by the following conveyance element and driving conveyance rollers, so that the surface of the paper is prevented from waving. Since the paper attracting element and the following conveyance element are fixed to the outer circumferential surface of the cylinder in such a manner that the cylinder is inserted through the paper attracting element and the following conveyance element, there is no need for performing any special processing for the cylinder.

In the paper feeding apparatus of the invention, with the setting of L1>L2, the attracting force when the air hole of the paper attracting element attracts paper in the vicinity of the paper outlet of the hopper becomes larger as the paper is conveyed further downstream in the direction of paper conveyance. Accordingly, the front end of the paper is more likely to be attracted, so that the separability of sheets of paper is enhanced and feeding plural sheets of paper at one time is less likely to occur.

In the paper feeding apparatus of the present invention, since the air hole region for attracting paper is formed into a flat surface, the paper is more likely to be attracted to the air hole region and a paper conveying force is increased, while the leakage of sucked air is less likely to occur in attracting the paper.

In the paper feeding apparatus of the invention, since the following conveyance element composed of the bearing is positioned while being held by the paper attracting element composed of the collars, there is no displacement of the following conveyance element. Moreover, the assembly process of attaching the following conveyance element and the paper attracting element to the cylinder is performed simply by inserting the cylinder through the collars and bearings in such an order as required.

In the paper feeding apparatus of the invention, even when the bearing is used as the following conveyance element, there is no possibility of the bearing being brought into direct contact with the paper to be fed, so that the paper is conveyed while being held between the ring-shaped cover and the driving conveyance rollers. In this case, the width of the ring-shaped cover may be set to an appropriate value irrespective of the width of the bearing. For example, it is possible to set the width of the ring-shaped cover larger than that of the bearing, thereby increasing a contact area between the driving conveyance rollers and the ring-shaped cover (following conveyance element) and hence increasing the paper conveying force.

According to the paper feeding apparatus of the present invention, it is possible to feed paper without giving a damage such as waving to the paper, while it is not necessary to perform special processing such as the formation of a concave portion in the cylinder, thereby constituting the apparatus at low cost.

According to the paper feeding apparatus of the invention, when the surface of the paper attracting element attracts the paper, the attracting force is greater at the downstream in a conveyance direction than at the upstream, resulting in increase of separability of sheets of paper. As a result, the paper can be conveyed without feeding plural sheets of paper at one time.

According to the paper feeding apparatus of the invention, the adsorptivity of the paper to the air hole region is improved, so that the performance of paper conveyance is increased and air leakage is less likely to occur in attracting the paper. As a result, the air sucking force can be utilized efficiently without being wasted, which enables the minimization of the suction capacity of the air sucking means. Moreover, there occurs no problem of noise resulting from air leakage.

According to the paper feeding apparatus of the invention, since there is no risk of displacement of the following conveyance element (bearing) when the paper is conveyed by the following conveyance element and driving conveyance rollers while being held therebetween, stable paper conveyance is realized. Moreover, the process of assembling the following conveyance element and the paper attracting element is remarkably simplified, thereby advantageously simplifying the manufacturing process as well as reducing the component count.

According to the paper feeding apparatus of the invention, paper can be prevented from being contaminated even when the bearing is used as the following conveyance element. Since a ring-shaped cover is provided on the bearing, it becomes possible to set the width of the following conveyance element to an appropriate value irrespective of the width of the bearing, thereby enlarging the area for transmitting the conveying force in conveying the paper (the contact area with the driving conveyance rollers) and enhancing the paper conveying force.

BRIEF DESCRIPTION OF THE DRAWINGS

Other and further objects, features, and advantages of the invention will be more explicit from the following detailed description taken with reference to the drawings wherein:

FIGS. 4A, 4B and 4C are views showing the structure of a rotary mechanism for rotating a cylinder of the paper feeding apparatus, FIG. 4A showing the off-state of a solenoid, and FIG. 4B showing the neutral state of the solenoid, FIG. 4C showing the on-state of the solenoid;

DETAILED DESCRIPTION OF THE PREFERRED EMBODIMENTS

Figure 1:
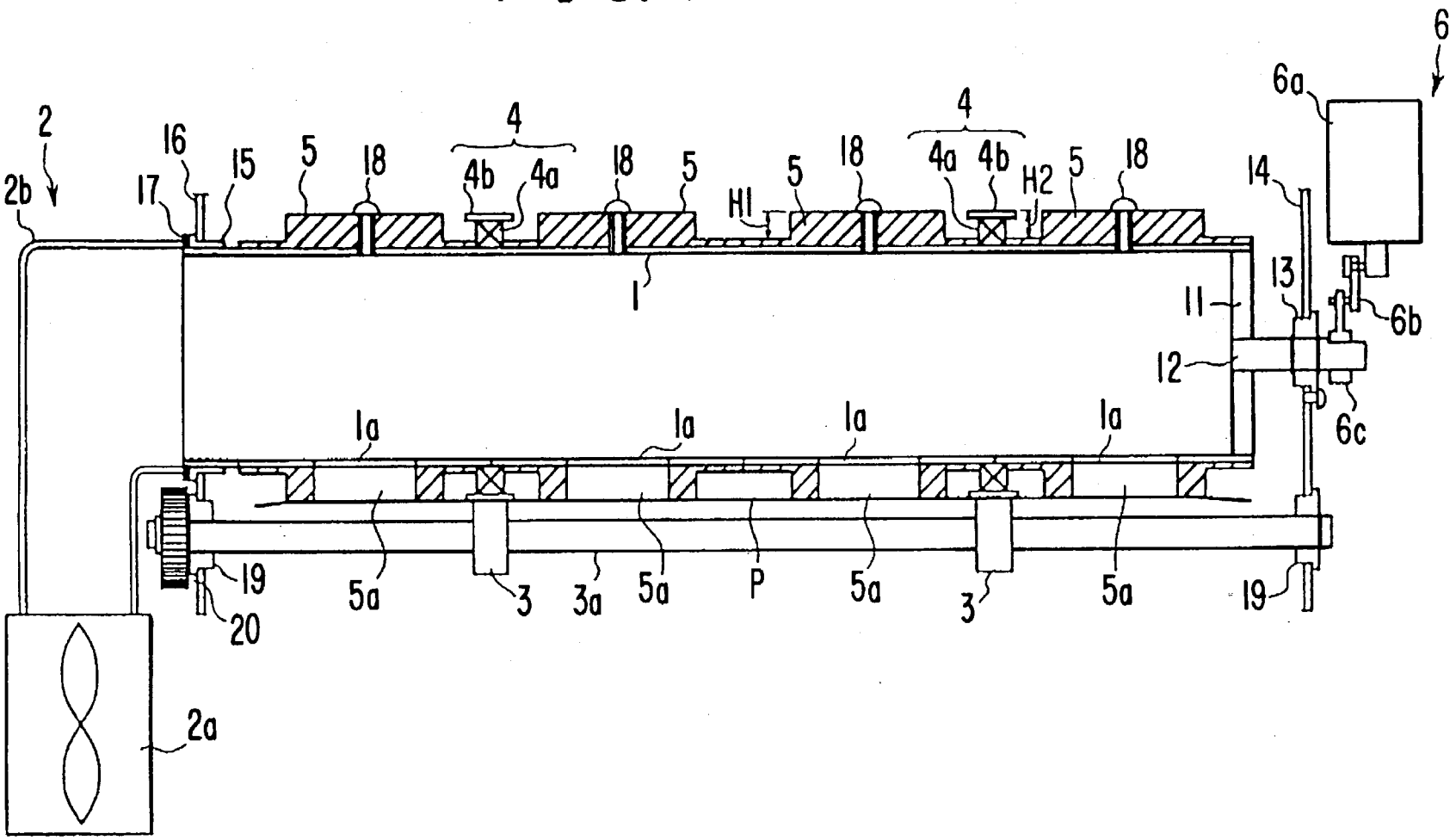
FIG. 1 is a view showing the cross-sectional side structure of a paper feeding apparatus of an embodiment of the invention.

Now referring to the drawings, preferred embodiments of the invention are described below.

Figure 2:
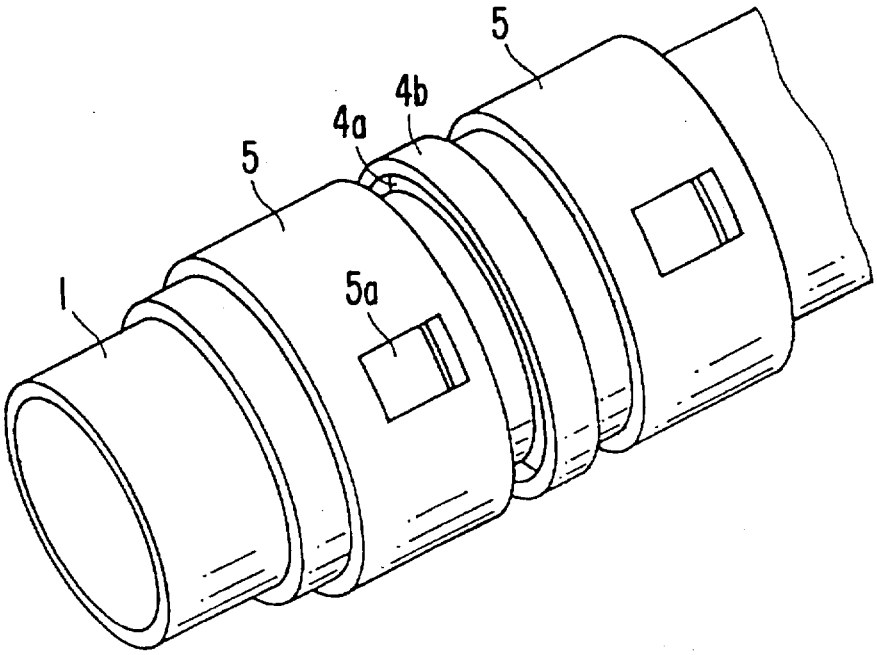
FIG. 2 is a perspective view showing the structure of a cylinder including relative parts as shown in FIG. 1.
Figure 3A:
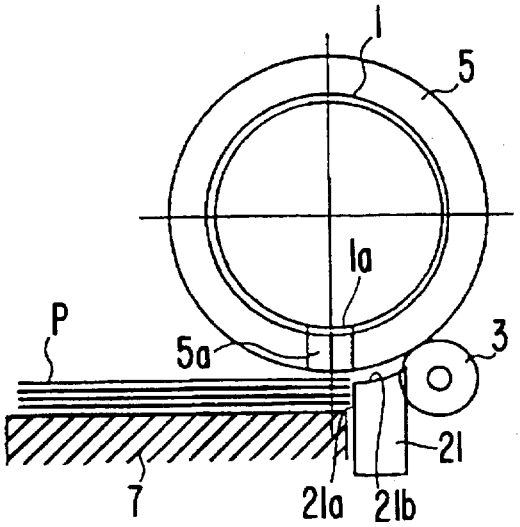
FIGS. 3A and 3B are views each showing the cross-sectional front structure of the paper feeding apparatus, FIG. 2A showing the apparatus in attracting paper, FIG. 2B showing the apparatus in feeding out the paper.
Figure 3B:
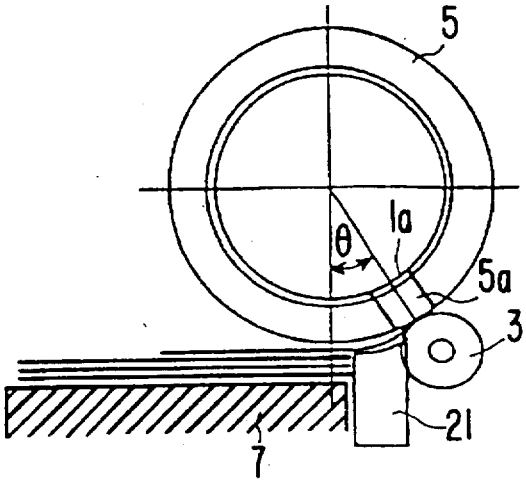

Below, embodiments of the present invention will be described with reference to the drawings. FIG. 1 is a cross-sectional side view of a cylinder portion of a paper feeding apparatus of an embodiment of the present invention. FIG. 2 is a perspective view of a cylinder portion of FIG. 1 and FIGS. 3A and 3B are views each showing the front structure of the apparatus. FIG. 4 is a view showing an example of the structure of a rotary mechanism (means for rotating a cylinder) of the cylinder of the apparatus. Of FIGS. 3A and 3B, FIG. 2A shows the apparatus in attracting paper with an air hole opposed to a paper outlet of a hopper and FIG. 2B shows the apparatus in which the attracted paper is opposed to driving conveyance rollers.

The cylinder 1 is provided above a front edge of the paper P containing hopper 7 (in the direction of paper conveyance). The cylinder 1 picks up the paper P in the hopper 7 one by one from the top thereof. The cylinder 1 has been formed into a drum from a rigid material such as metal. In FIG. 1, the left end of the cylinder 1 is opened, while a flange 11 provided with a rotary shaft 12 is disposed at the right end of the cylinder 1. The rotary shaft 12 is attached to the flange 11 by swagging, while the flange 11 is pressed into and attached to the right end of the cylinder 1, thereby realizing adhesion free from air leakage. The rotary shaft 12 is pivotally supported by a bearing 13, which is fixed to a rear housing 14 of an apparatus (such as an image forming apparatus) comprising the paper feeding apparatus. Behind the housing 14, the rotary shaft 12 is provided with a rotary mechanism (means for rotating a cylinder) 6.

The left end of the cylinder 1 is pivotally supported by a bearing 15 provided in a front housing 16 of the image forming apparatus. To the left end of the cylinder 1 is connected a duct **2*b* which is connected to a suction fan 2*a*. The connection between the cylinder 1 and the duct 2*b* is provided with a cushioning material 17** such as an O ring for preventing the leakage of sucked air.

The circumferential surface of the cylinder 1 is provided with a plurality of air holes **1*a*** (four air holes in this embodiment) which are aligned in the axial direction.

Following conveyance elements 4 and collars (paper attracting elements) 5 are attached to the outer circumferential surface of the cylinder 1 in such a manner that the cylinder 1 is inserted through the following conveyance elements 4 and collars 5. Each of the following conveyance elements 4 consists of a bearing 4*a* and a ring-shaped cover 4*b* attached to the outer circumferential surface of the bearing 4*a*. The cover 4*b* is fixed to the outer ring of the bearing 4*a* by adhesion or fitting. With the provision of the cover 4*b*, the bearing 4*a* coated with an anticorrosive oil or the like is not brought in direct contact with the paper, thereby preventing paper contamination.

The cover 4*b* is made of an elastic material such as resin or rubber and so designed as to hold the paper between the driving conveyance roller 3 and the cover itself without skid. In the case where a conductive material such as carbon block is mixed in a material such as resin or rubber composing the cover 4*b*, the electrical charging of the cover 4*b* can be prevented, thus preventing the electrostatic attachment of paper powder or the like from being attached to a surface of the cover 4*b*. Consequently, the paper being conveyed can be prevented from skidding as well as being cleaved to the cover 4*b*, resulting in smooth conveyance of the paper.

Figure 5:
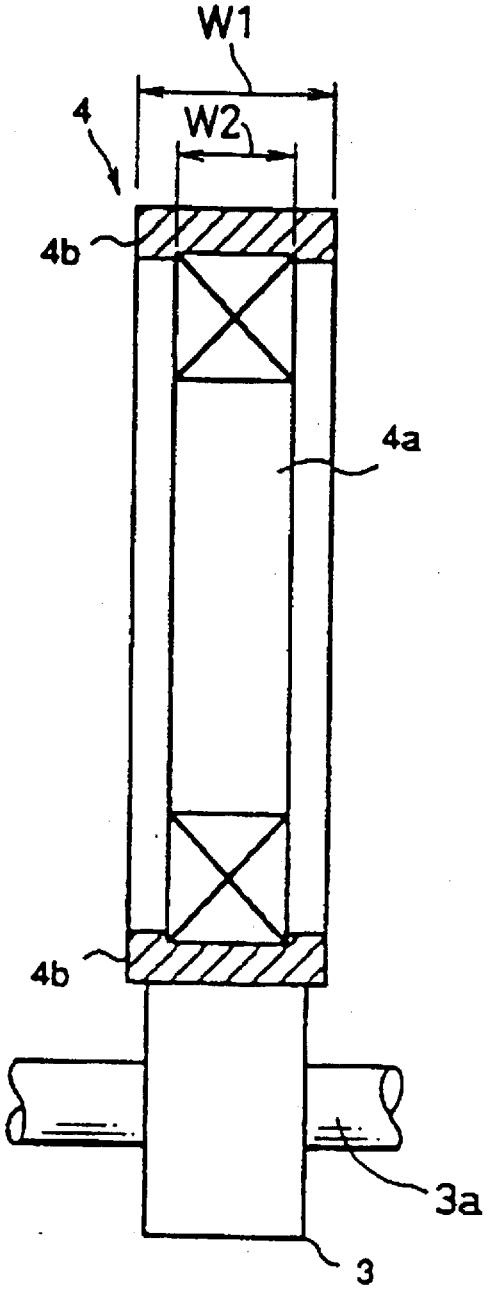
FIG. 5 is a view showing the structure of a following conveyance element.

The width W1 of the cover 4*b* is set to be at least larger than the width W2 of the bearing 4*a*. The width W1 can be set to an arbitrary value in contrast with the bearing 4*a* having a standardized size. As shown in FIG. 5, since the width W1 of the cover 4*b* has been set larger than the width W2 of the bearing 4*a* in the present embodiment, an area of the cover 4*b* used for holding the paper between the driving conveyance roller 3 and the cover 4*b* is increased, which advantageously improves the efficiency with which the paper conveying force is transmitted. Moreover, since the width W1 of the cover 4*b* has been set larger than the width W2 of the bearing 4*a*, the anticorrosive oil or the like coated on the bearing 4*a* can be inhibited from reaching the paper, thus preventing paper contamination. Here, the term "width" is defined as a length in the axial direction of an element which has been attached to the cylinder.

Two following conveyance elements 4 are attached to the cylinder 1 in such a manner that the cylinder 1 is inserted through the two following conveyance elements 4. Between the two following conveyance elements 4 are interposed the ring-shaped collars 5 through which the cylinder 1 has been inserted. The following conveyance elements 4 have been positioned by means of the collars 5. Each of the collars 5 is a ring-shaped element formed from a resin such as ABS or PS by molding and has a concave portion in cross section. The collars 5 are attached to the surface of the cylinder 1 from one end of the cylinder 1 in such a manner that the cylinder 1 is inserted through the collars 5 and then secured thereto with small screws 18. In the structure of the cylinder 1 according to the present embodiment shown in the drawings, one collar 5, one following conveyance element 4, two collars 5, one following conveyance element 4, and one collar 5 are sequentially attached to the cylinder 1 from one end thereof in such a manner that the cylinder 1 is inserted through the foregoing elements in this order and, after that, the collars 5 are secured to the cylinder 1 by means of the small screws 18 in the assembly process. In the process, the positions at which the collars 5 are screwed are determined such that the small screws 18 are kept away from the paper on the top-surface side of the cylinder 1, thereby preventing the conveyance of the paper from being affected by screwing. The following conveyance elements 4 are held between the collars 5 secured to the cylinder 1 with the small screws in the axial direction of the cylinder 1, thus preventing displacement. The collars 5 attached to the cylinder 1 may have equal sizes so as to be stacked, thereby lowering the manufacturing cost of the collars. However, the collars may also have different sizes as required such that the collar at the middle position becomes larger in size than the collars on both ends, thereby advantageously reducing the number of collars to be attached and hence the number of manufacturing steps.

The top-surface height H1 of the collars 5 are set to be substantially flush with the top-surface height H2 of the following conveyance elements 4. As shown in FIG. 1, when the paper P is placed on the top surfaces of the collars 5 and on the top surfaces of the following conveyance elements 4, the top surface of the paper presents a substantially linear contour in cross section. The circumferential surfaces of the collars 5 are provided with respective air holes 5*a*. Each of the air holes 5*a* has the same configuration as that of each of the air holes 1*a* formed in the cylinder 1*a*. When the collars 5 are secured to the cylinder 1 by means of small screws, the air holes 5*a* are brought into communication with the corresponding air holes 1*a* of the cylinder. Here, the term "top-surface height" is defined as a distance between the top surface of an element which has been attached to the cylinder and the outer circumferential surface of the cylinder. The top surface is also defined as the outermost surface when viewed from the cylinder.

Driving conveyance rollers 3 serving as driving conveyance elements are disposed to contact with the following conveyance elements 4. The driving conveyance rollers 3 are positioned slightly downstream of the hopper 7 in the direction of paper conveyance. The paper is fed from the hopper 7 and held between the following conveyance elements 4 and the driving conveyance rollers 3 which are provided around the rotary shaft 3*a*, which is pivotally supported by the housings 14 and 16 of the image forming apparatus or the like via a bearing 19. To the rotary shaft 3*a* is transmitted a rotary force from a driving system (not shown) by means of a gear 20.

Between the hopper 7 and the driving conveyance rollers 3 are interposed paper guiding elements 21. Each of the paper guiding elements 21 has a edge controlling surface 21*a* for evening up the edges of the sheets of paper P contained in the hopper 7 and a guiding surface 21*b* for guiding the paper P attracted by the cylinder 1 to the driving conveyance rollers 3.

The rotary mechanism 6 has a solenoid 6*a*, an operating arm 6*b*, a connecting arm 6*c*, and a spring 6*d*. As indicated by arrows R1 and R2 in FIG. 3, the solenoid 6*a* is for generating a linear force when the solenoid 6*a* is turned on. The operating arm 6*b* converts the linear pressing force into a swinging force indicated by arrow R3 in FIG. 4 and transmits the swinging force to the connecting arm 6*c*. One end of the connecting arm 6*c* is secured to the rotary shaft 12 of the cylinder 1 and the other end thereof is provided with the spring 6*d* for exerting a rotary force in the direction opposite to the direction of paper conveyance. The swinging force transmitted from the operating arm 6*b* is transmitted to the other end of the connecting arm 6*c*. Thereby the cylinder 1 to which the connecting arm 6*c* is fixed obtains the rotary force in the direction of paper conveyance against the biasing force of the spring 6*d*. the operating arm 6*b* is composed of two arms 6*e* and 6*f*. The arm 6*e* is longer than the arm 6*f*. One end of each arm is fixed to each other at right angles by a pin β, and the operating arm 6*b* is arranged rotatably about the pin β. The other end of the shorter arm 6*f* in connected to an operating piece 6*i* of the solenoid 6*a* by a pin α. The arm 6*f*, namely the operating arm 6*b*, is provided rotatably about the pin α. The longer arm 6e has a protrusion 6g at the other end thereof. The connecting arm 6c has an oval hole 6h on the side of the other end, the oval hole 6h being parallel to the radial direction of the cylinder 1. The protrusion 6g is movably inserted into the oval hole 6h.

FIG. 4A is a view showing the off-state of the solenoid 6a, FIG. 4B is a view showing the neutral state of the solenoid 6a, and FIG. 4C is a view showing the on-state of the solenoid 6a. When the solenoid 6a is in the off-state, the movable piece 6i is protruded in the direction of arrow R1, while the protrusion 6g and the oval hole 6h are engaged with each other to hold the cylinder 1 at a predetermined position. When the solenoid 6a is turned on, as shown in FIG. 4B, the movable piece 6i moves to the direction of arrow R2, thereby angularly displacing the operating arm 6b in the direction of arrow R3. Additionally, the connecting arm 6c and the cylinder 1 are angularly displaced against the urged force of the spring 6d by the protrusion 6g. Finally, as shown in FIG. 4C, the operating arm 6b is held at a predetermined angle, thereby holding the cylinder 1 at the predetermined position. In other words, when the solenoid 6a is in the off-state, the respective air holes 1a and 5a of the cylinder 1 and the collars 5 are opposed to the edges (paper outlet) of the sheets of paper in the hopper 7, as shown in FIG. 3A. When the solenoid 6b is in the on-state, on the other hand, the respective air holes 1a and 5a of the cylinder 1 and the collars 5 are opposed to the driving conveyance rollers 3, as shown in FIG. 3B.

A description will be given to the paper feeding operation in the paper feeding apparatus thus constituted. In feeding paper, a sucking fan 2a is initially turned on so as to introduce a sucking force into the cylinder 1. The sucking force sucks the edge of the paper P in the hopper 7 through the air holes 1a and 5a. On the other hand, the rotary force is transmitted to the driving conveyance rollers 3 via the gear 20, which rotates the driving conveyance rollers 3, the outer rings of the bearings 4a, and the covers 4b. However, the rotation exerts no influence on the cylinder 1. Subsequently, the solenoid 6a is turned on, which rotates the cylinder 1 in the direction of paper conveyance by an angle of θ as shown in FIG. 3B, thereby shifting the edge of the paper P to a position between the driving conveyance rollers 3 and the following conveyance elements 4, while the edge of the paper P remains sucked by the air holes 1a and 5a. Since the driving conveyance rollers 3, the outer rings of the bearings 4a of the following conveyance elements 4, and the covers 4b thereof are rotating, as described above, the paper P having shifted is conveyed toward a paper conveying path (not shown), while being held engagedly between the driving conveyance rollers 3 and the following conveyance elements 4. After that, the solenoid 6a is turned OFF and the cylinder 1 rotates in the direction opposite to the direction of paper conveyance, thereby returning to the initial state shown in FIG. 3A.

Figure 6:
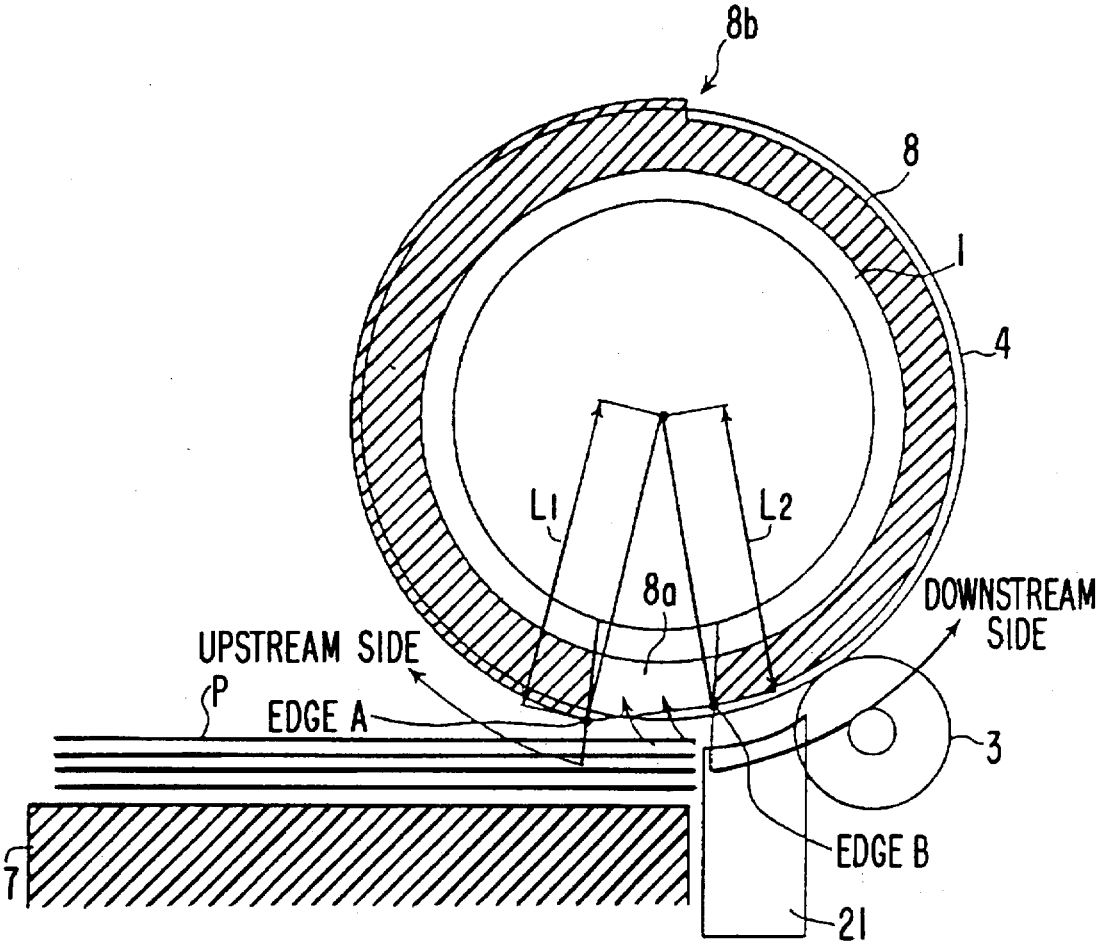
FIG. 6 is a cross-sectional front view showing a principal portion of a paper feeding apparatus of another embodiment of the invention.
Figure 7:
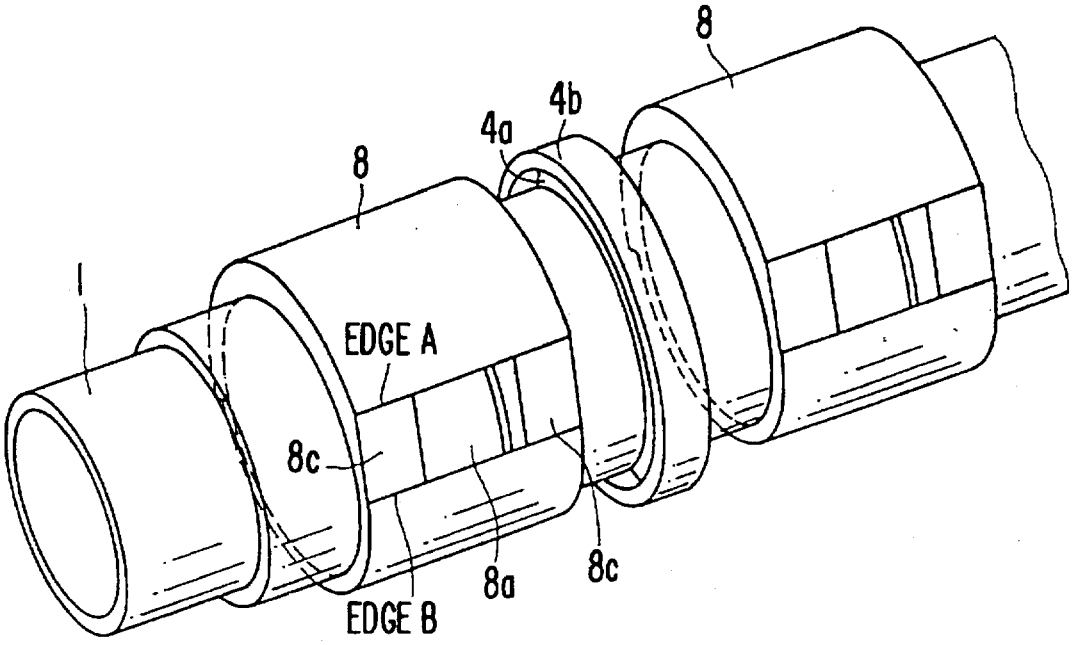
FIG. 7 is a perspective view showing the structure of a cylinder including the relative parts as shown in FIG. 6.

A description will be given to another example of the structure of the invention. FIG. 6 shows the cross sectional structure of the cylinder portion of the embodiment. FIG. 7 is a perspective view of the cylinder including the relative parts.

The structure of the cylinder 1 is the same as the structure of the cylinder 1 shown in the foregoing embodiment, except that the structure of each of the collars 8 is different from the structure of each of the collars 5 in the foregoing embodiment. Although the collars 8 of this embodiment are substantially ring-shaped, the collars 8 are designed to have top-surface radii different between at the upstream side and at the downstream side in the direction of paper conveyance relative to the air holes 8a of the collars 8. In other words, the collars 8 are so constituted that the top-surface radius L2 of the collar 8 at the downstream side is shorter than the top-surface radius L1 of the collar 8 at the upstream side. Moreover, the edge A of the air hole 8a at the upstream side and the edge B of the air hole 8a at the downstream side are connected to each other as to be in one plane. Specifically, as shown in FIG. 7, a boundary portion 8c of the end of the portion of the collar 8 having a larger radius and the end of the portion of the collar having a smaller radius is formed into a flat plane, and an air hole 8a is formed in the center of the boundary portion 8c. Since the region of the collar joints 8b located on the opposite side (top-surface side) of the air holes 8a have no relation with paper conveyance, there should be no problem with the collar joints 8b formed into steps as shown in the drawing. However, it is also possible to form the collar joints 8b into flat ones. Here, the term "top-surface radius" is defined as a distance between an element which has been attached to the cylinder and the axis of the cylinder.

When air suction is performed with the settings of the top-surface radius L1 of the collar 8 at the upstream side and the top-surface radius L2 of the collar 8 on the downstream side which satisfy a relationship represented by L1>L2 as described above, air is easily allowed to flow from the side with the shorter radius, resulting in an air flow into the cylinder 1 from the downstream side, as indicated by the arrows in the drawing. Consequently, the sucking force with respect to the paper P is increased toward the edge of the paper, thus enhancing the separability of stacked sheets of paper and therefore preventing the paper from being fed in plural of the paper.

When the edge A of the air hole 8a at the upstream side and the edge B of the air hole 8a at the downstream side are connected to each other so as to form one plane, as described above, the paper P is attracted by the entire sucking surface for the paper P (air hole 8a portion), so that air leakage is less likely to occur at the time of air suction and the performance in conveying the paper P is increased. Since air leakage is less likely to occur, noise is advantageously eliminated and a sucking device (fan or motor) for performing air suction can be miniaturized with no waste of air.

There will be shown another embodiment of the present invention.

Figure 8:
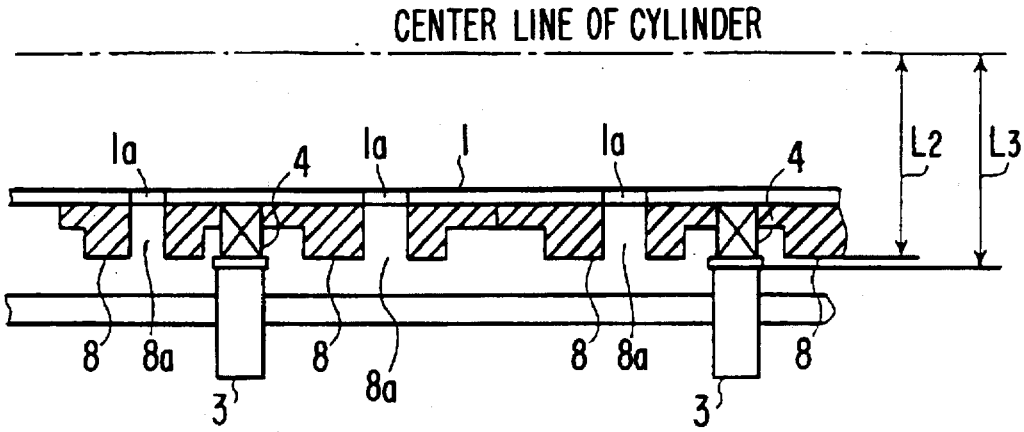
FIG. 8 is a view showing the structure of a paper feeding apparatus of still another embodiment.

FIG. 8 is a view according to another embodiment of the present invention, in which is shown the structure of the cylinder 1 portion. In the present embodiment, the top-surface radius L2 of the collar 8 at the downstream side and the top-surface radius L3 of each of the following conveyance elements 4 are set to have a relationship represented by L3>L2. With the setting, contamination of the paper P in attracting the paper P to the air hole 8a region can be prevented. In the case where L3<L2 is satisfied, as a result the following conveyance elements 4 are lower in level than the peripheral portions thereof, so that the paper is caught in the concave portions at which the following conveyance elements 4 is provided when the paper is attracted, which increases the probability of paper contamination by oil or the like coated on the bearings 4a of the following conveyance elements 4. With the setting of L3>L2, however, the following conveyance elements 4 are higher in level than the peripheral portions thereof, so that the foregoing problem of contamination by oil is less likely to occur. Moreover, when the paper P meshes with the driving conveyance rollers 3 and following conveyance elements 4 to be held therebetween, the meshing operation is performed more smoothly with the setting of L3>L2. This is because the paper P is brought to the position of the driving conveyance rollers 3 while they are disposed on the following conveyance elements 4 and then the driving conveyance rollers 3 contact with the following conveyance elements 4 with the paper P interposed therebetween. Consequently, the paper P is held between the following conveyance elements 4 and the driving conveyance rollers 3 with no waving observed thereon. The difference between L3 and L2 in the case where L3>L2 is satisfied is set so as not to cause waving on the paper. In other words, the radius L3 is slightly longer than but substantially equal in length to the radius L2. Specifically the radius L3 is set longer than the radius L2 by 0.5 to 1.5 mm.

Figure 9:
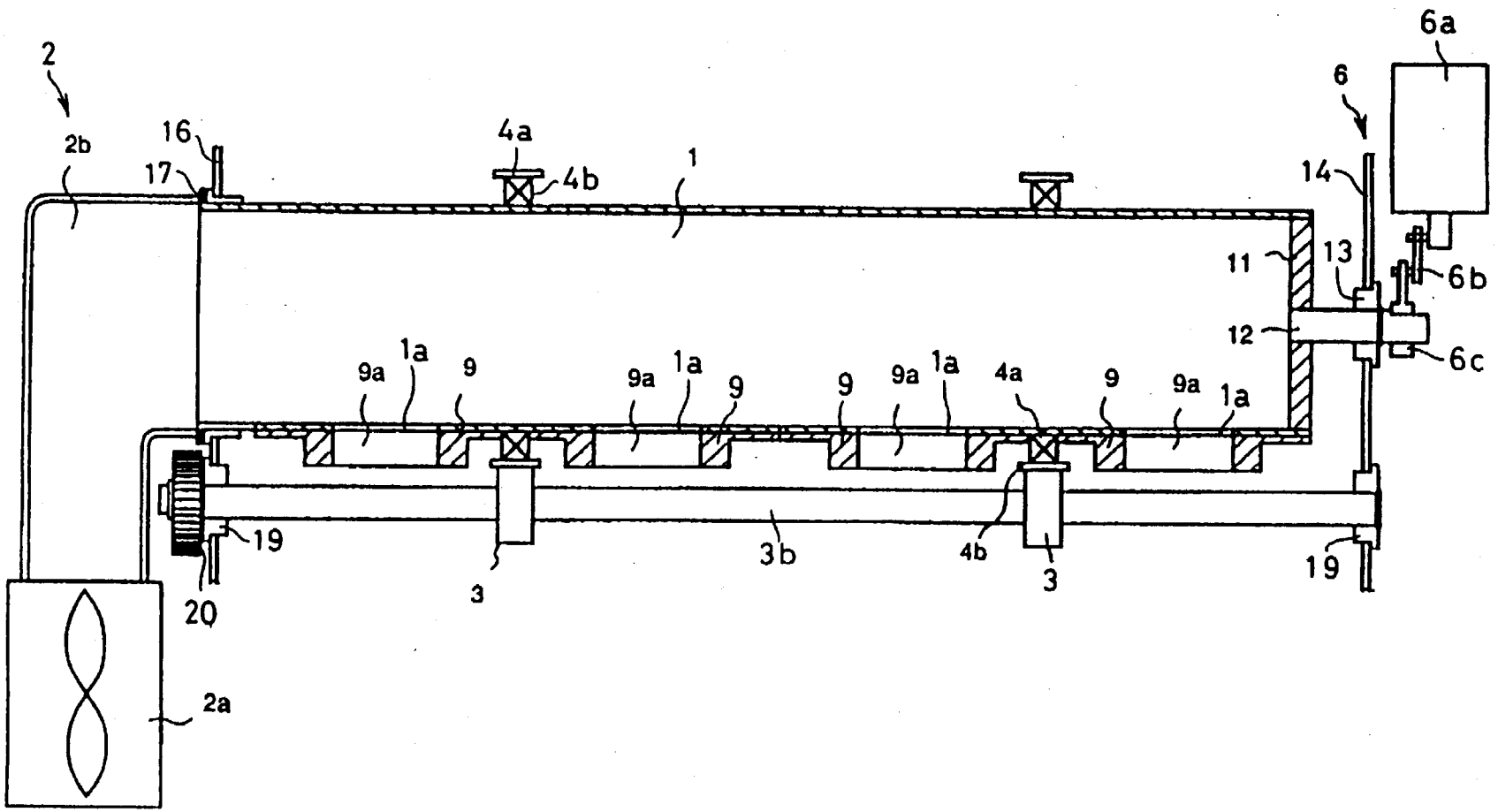
FIG. 9 is a cross-sectional side view showing the structure of a paper feeding apparatus of yet another embodiment.
Figure 10:
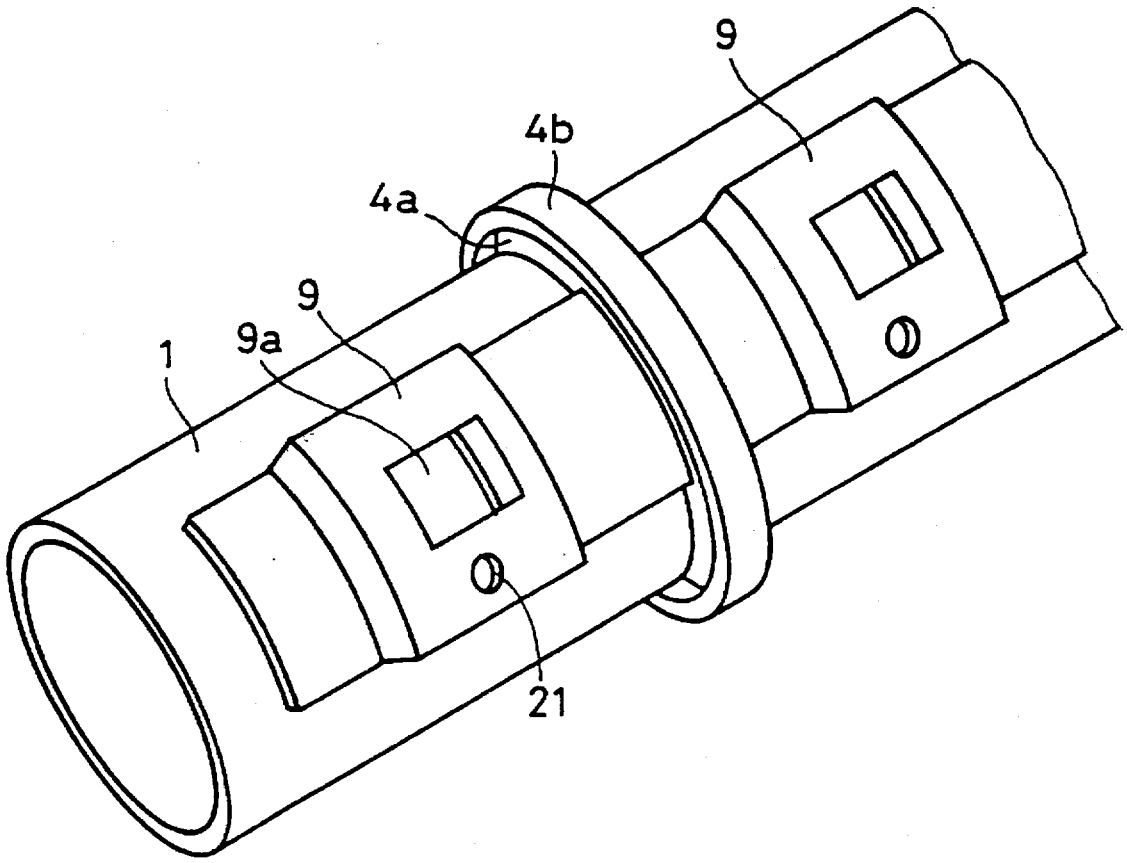
FIG. 10 is a perspective view showing the structure of a cylinder including the relative parts as shown in FIG. 9.
Figure 11A:
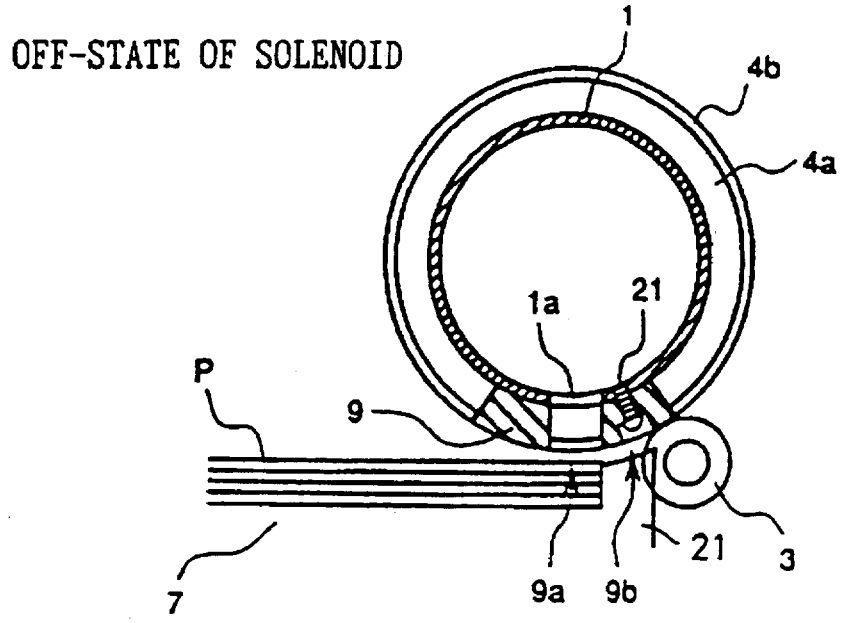
FIGS. 11A and 11B are cross-sectional front views of the paper feeding apparatus, FIG. 11A showing the apparatus in attracting paper, FIG. 11B showing the apparatus in feeding out the paper.
Figure 11B:
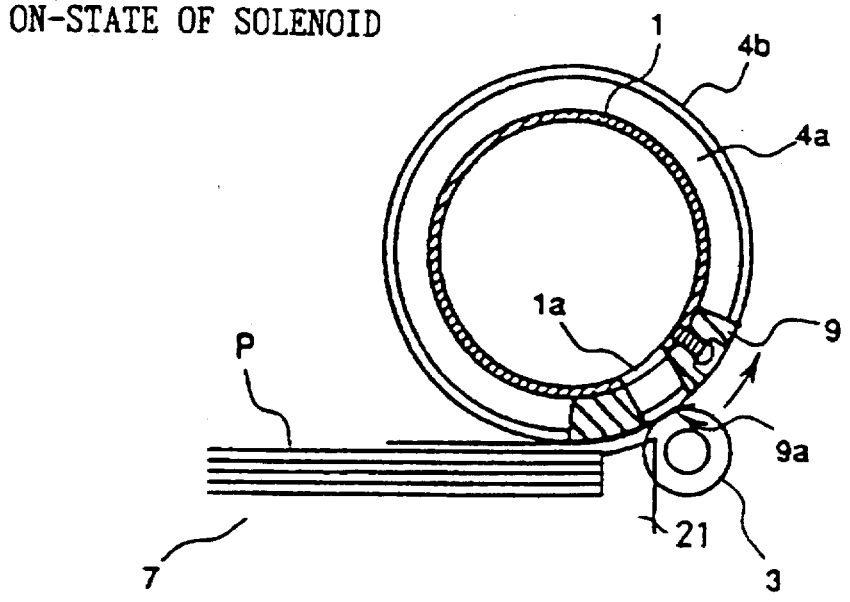

FIGS. 9 through 11 are views showing still another embodiment of the present invention. FIG. 9 is a cross sectional side view of a paper feeding apparatus, FIG. 10 is a perspective view of the cylinder including the relative parts, and FIGS. 11A and 11B are cross-sectional front views of the apparatus. Although the collars 5 and 8 of the foregoing embodiment which are ring-shaped and cover the whole circumferential surface of the cylinder, collars 9 of this embodiment is formed so that only a portion of the collar 9 required for the paper feeding process presents an arc cross section. Specifically, the collars 9 are so configurated that, in attracting paper (when the solenoid 6*a* is in the OFF state), the downstream ends of the arc portions thereof in the direction of paper conveyance are positioned upstream of the driving conveyance rollers 3, as shown in FIG. 11A, so that the collars 9 contact with the driving conveyance rollers 3, and that, in feeding the paper (when the solenoid 6*a* is in the on state), the upstream ends of the arc portions thereof in the direction of paper conveyance are positioned upstream of the driving conveyance rollers 3, as shown in FIG. 11B, so that the collars 9 contact with the paper P in the hopper 7. The size of each of the collars 9 actually required for conveying the paper is as shown in the this embodiment. By thus minimizing the size of the collar 9, material cost can be reduced.

The collars 9 are provided with air holes 9*a* communicating with the air holes 1*a* of the cylinder 1, similarly to the collars 5 and 8 of the embodiments described above. In order to position and fix the collars 5 and 8 to the cylinder 1, in the foregoing embodiments, the collars 5 and 8 are fixed to the cylinder 1 by means of small screws in a region not used for conveying the paper (on the top-surface side of the cylinder 1). In this embodiment, however, it is necessary to fix the collars 9 to the cylinder 1 by means of small screws at portions used for conveying the paper. Therefore, as shown in FIGS. 11A and 11B, a hole 9*b* which barely allows the insertion of the head of the small screw 21 is formed in a part of each of the collars 9, thus preventing the screw 21 from affecting paper conveyance.

Figure 12:
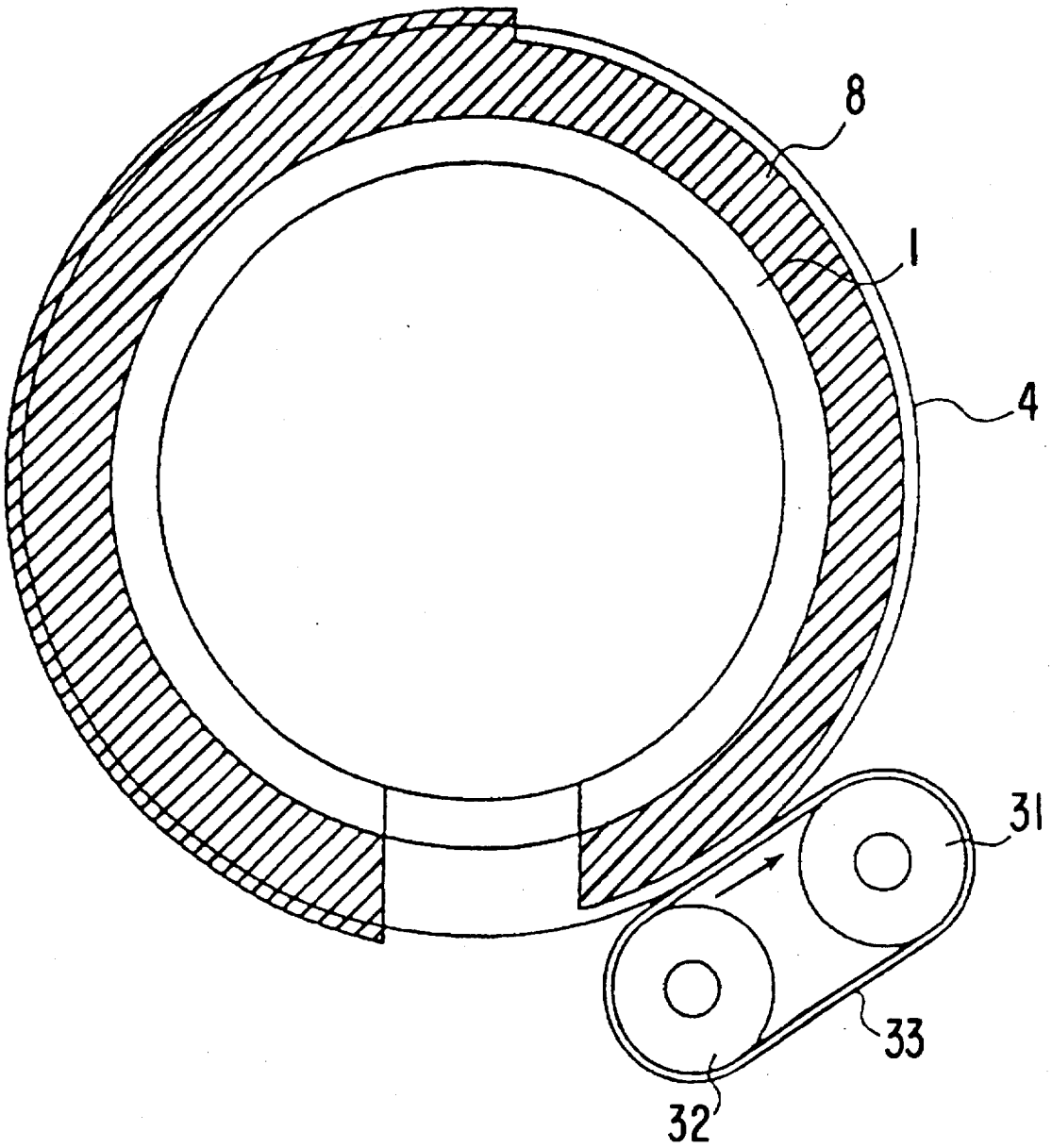
FIG. 12 is a cross-sectional front view showing the structure of a principal portion of a paper feeding apparatus of further embodiment.
Figure 13A:
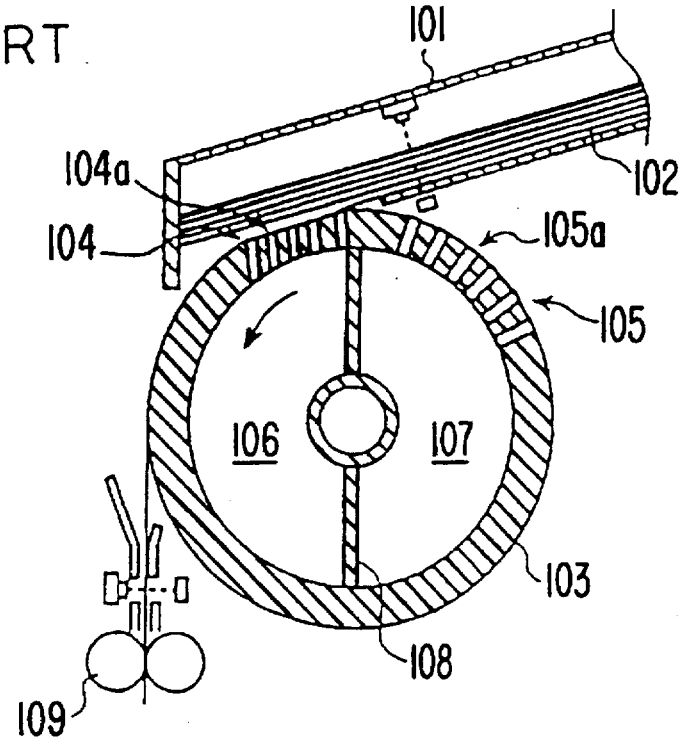
FIG. 13A PRIOR ART
FIGS. 13A and 13B are views showing an example of the structure of a conventional paper feeding apparatus.
Figure 13B:
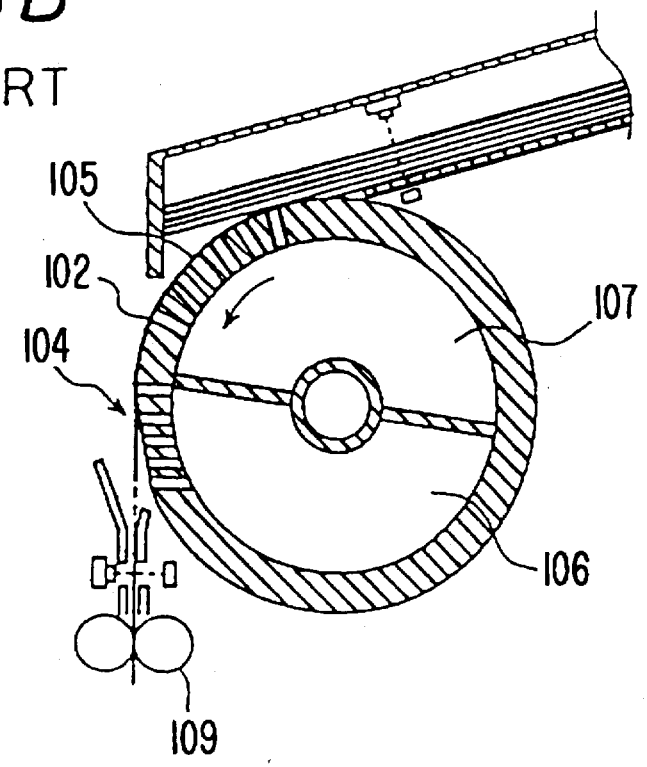
FIG. 13B PRIOR ART
Figure 14A:
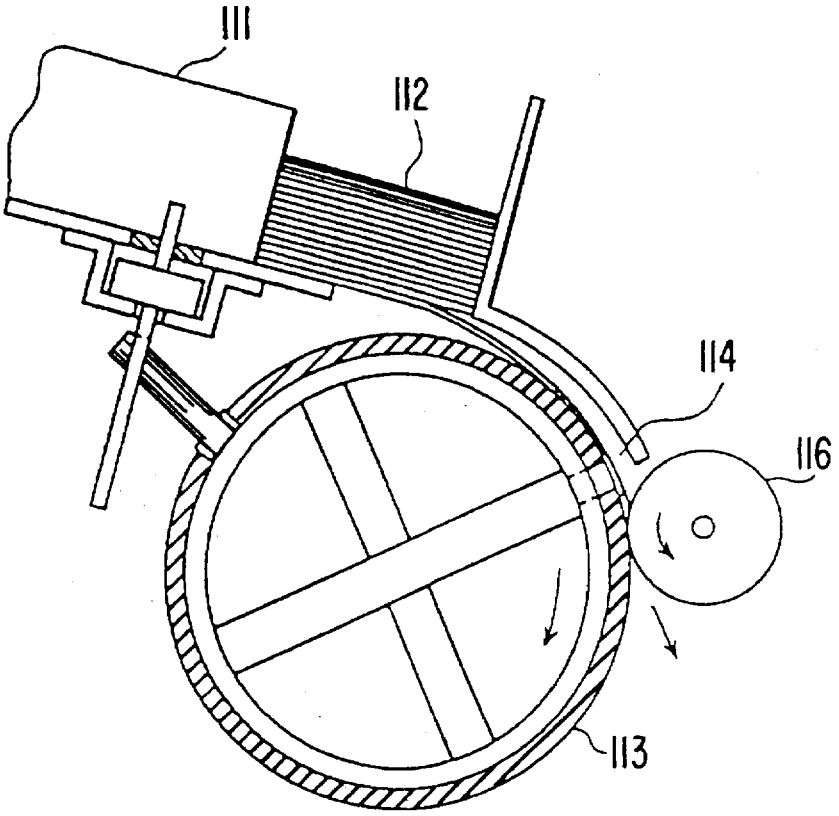
FIG. 14A PRIOR ART
FIGS. 14A is a view showing another example of the structure of the conventional paper feeding apparatus.
Figure 14B:
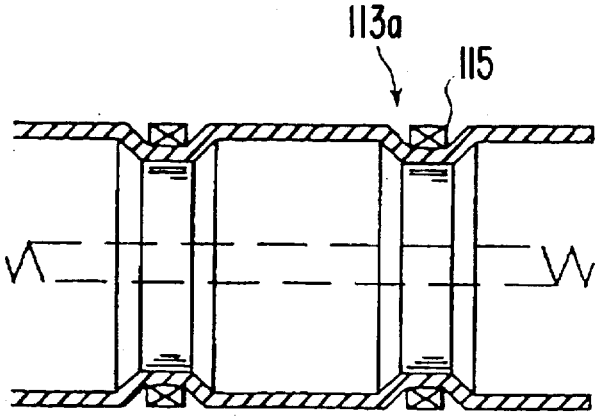
FIG. 14B PRIOR ART
FIG. 14B is a sectional view of a feeder of the conventional paper feeding apparatus.

FIG. 12 is a view showing still another embodiment of the present invention. In a paper feeding apparatus of this embodiment, the driving conveyance element is composed of one in the form of a belt. The driving conveyance element has a driving roller 31, a following roller 32, and a belt 33 stretched between the two rollers 31 and 32 and presses the belt 33 onto the following conveyance elements 4. When a rotary force is supplied to the driving roller 31 in feeding paper, the belt 33 rotates in the direction of paper conveyance as indicated by the arrow in the drawing, so that the paper P is conveyed while being held between the belt 33 and the following conveyance elements 4. By thus using the driving conveyance element in the form of a belt, the pressing force for pressing the driving conveyance element (belt 33) onto the following conveyance elements 4 can be varied in a sufficiently wide range, which facilitates the design and assembly of the apparatus. In addition, the degree of abrasion of the driving conveyance element and following conveyance elements 4 is advantageously reduced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A paper feeding apparatus comprising:

a drum-shaped cylinder, having an outer circumferential face with at least one air hole, disposed in the vicinity of a paper outlet of a hopper for containing sheets of paper;

suction means for removing air from the interior of the cylinder;

a driving conveyance element disposed in the vicinity of the outer circumferential surface of the cylinder;

a following conveyance element provided on the outer circumferential surface of the cylinder, the following conveyance element being rotatable independent of rotation of the cylinder and being contacted with the driving conveyance element;

a paper attracting element secured to the outer circumferential surface of the cylinder and having an air hole communicating with an air hole of the cylinder, the paper attracting element top surface is substantially flush with the top surface of the following conveyance element; and cylinder rotating means for rotating the cylinder and the at least one air hole between the vicinity of the paper outlet and the driving conveyance element.

2. The paper feeding apparatus of claim 1, wherein a distance L1 between the top face edge of the air hole at the upstream side in a direction of paper conveyance and the axial line of the cylinder rotation and a distance L2 between the top face edge of the air hole at the downstream side in the direction of paper conveyance and the axial line of the cylinder rotation are set to have a relationship represented by L1>L2.

3. The paper feeding apparatus of claim 2, wherein a face including the top face edge of the air hole at the upstream side in a direction of paper conveyance and the top face edge of the air hole at the downstream side in the direction of paper conveyance is formed into a planar face.

4. The paper feeding apparatus of claim 1, wherein the driving conveyance element is a roller.

5. The paper feeding apparatus of claim 1, wherein the driving conveyance element contains a driving roller, a following roller and a belt expanding between the driving roller and the following roller.

6. The paper feeding apparatus of claim 1, wherein the length of the paper attracting element is selected so that, when the air hole is positioned in the vicinity of the paper outlet, the edge of the paper attracting element at the downstream side in the conveyance direction contacts with the driving conveyance element, and when the air hole is positioned in the position of the driving conveyance element, the edge of the paper attracting element at the upstream side in the conveyance direction is positioned in the vicinity of the paper outlet.

7. The paper feeding apparatus of claim 1, wherein the paper attracting element is a ring-shaped collar having a top surface with different radii.

8. The paper feeding apparatus of claim 1, wherein the paper attracting element is at least one collar shaped element in contact only with a portion of the cylinder.

9. The paper feeding apparatus of claim 1, wherein the cylinder has a plurality of holes and the paper attracting element has a plurality of holes which each one of the plurality of holes in the paper attracting element being in communication with one distinct hole in the cylinder.

10. The paper feeding apparatus of claim 1, wherein there are a plurality of paper attracting elements with different sizes.

11. The paper feeding apparatus of claim 1, wherein the paper attracting element secures the following conveyance element to the cylinder.

12. A paper feeding apparatus comprising:

a drum-shaped cylinder disposed in the vicinity of a paper outlet of a hopper containing sheets of paper, in a circumferential face of which is formed an air hole;

sucking means for sucking air from the interior of the cylinder;

a driving conveyance element disposed in the vicinity of the outer circumferential surface of the cylinder;

a following conveyance element provided on the outer circumferential surface of the cylinder, the following conveyance element being rotatable independent of rotation of the cylinder and being contacted with the driving conveyance element;

a paper attracting element secured to the outer circumferential surface of the cylinder and having an air hole communicating with an air hole of the cylinder, the paper attracting element top surface is substantially flush with the top surface of the following conveyance element; and cylinder rotating means for rotating the cylinder and the air hole between the vicinity of the paper outlet and the driving conveyance element, wherein the paper attracting element is composed of a plurality of collars and the following conveyance element is composed of a bearing, the bearing being positioned on the outer circumferential surface of the cylinder and secured thereto by holding the bearing between the collars.

13. The paper feeding apparatus of claim 12, wherein the bearing of the following conveyance element has a ring-shaped cover made of an elastic material such as resin or rubber on a circumferential surface thereof.

14. The paper feeding apparatus of claim 13, wherein the elastic material includes electrically conductive materials.

15. The paper feeding apparatus of claim 13, wherein the width of the cover is selected to be larger than that of the bearing.

16. A paper feeding apparatus comprising:

a drum-shaped cylinder having a hollow interior and an outer circumferential face with at least one air hole;

suction means for removing air from the interior of the cylinder;

a driving conveyance element disposed in the vicinity of the outer circumferential surface of the cylinder;

a following conveyance element provided on the outer circumferential surface of the cylinder and having a first radius, the following conveyance element being rotatable independent of rotation of the cylinder and being contacted with the driving conveyance element;

a collar-shaped paper attracting element secured to the outer circumferential surface of the cylinder and having an air hole communicating with an air hole of the cylinder, and having a second radius which is less than said first radius, and rotating means for rotating the cylinder between a vicinity of a paper outlet and the driving conveyance element.

* * * * *